US006869274B2

(12) United States Patent
Niethammer

(10) Patent No.: US 6,869,274 B2
(45) Date of Patent: Mar. 22, 2005

(54) METHOD OF REDUCING PRESSURE PEAKS IN A FUEL INJECTOR

(75) Inventor: Bernd Niethammer, Blythewood, SC (US)

(73) Assignee: Siemens Diesel Systems Technology, Blythewood, SC (US)

( * ) Notice: Subject to any disclaimer, the term of this patent is extended or adjusted under 35 U.S.C. 154(b) by 0 days.

(21) Appl. No.: 10/631,750

(22) Filed: Aug. 1, 2003

(65) Prior Publication Data

US 2004/0022642 A1 Feb. 5, 2004

Related U.S. Application Data

(62) Division of application No. 10/079,489, filed on Feb. 22, 2002.

(60) Provisional application No. 60/283,629, filed on Apr. 16, 2001.

(51) Int. Cl.[7] ..... F04B 19/24; F04B 49/00; F04B 25/00; F04B 23/04

(52) U.S. Cl. ..... 417/53; 417/300; 417/304; 417/286; 417/288; 417/426; 417/428

(58) Field of Search ..... 417/53, 300, 302, 417/303, 304, 286, 288, 426, 428; 123/467, 466

(56) References Cited

U.S. PATENT DOCUMENTS 3,699,774 A * 10/1972 Davis et al. ..... 60/39.281
4,142,842 A 3/1979 Hicks et al.
4,599,051 A 7/1986 Numazawa et al.
4,787,204 A 11/1988 Mickelson
5,163,542 A 11/1992 Saiga
5,176,120 A * 1/1993 Takahashi ..... 123/467
5,197,438 A * 3/1993 Yamamoto ..... 123/506
5,199,854 A 4/1993 Aoyama
5,357,929 A 10/1994 McCandless
5,458,103 A 10/1995 Lauvin
5,511,528 A * 4/1996 Iwanaga et al. ..... 123/467
5,619,969 A * 4/1997 Liu et al. ..... 123/447
5,678,521 A * 10/1997 Thompson et al. ..... 123/447
6,112,721 A * 9/2000 Kouketsu et al. ..... 123/447

* cited by examiner

*Primary Examiner*—Cheryl J. Tyler
*Assistant Examiner*—Timothy P. Solak
(74) *Attorney, Agent, or Firm*—McGuireWoods LLP

(57) ABSTRACT

A multiple stage pump having valves upstream from each respective pump in a same line thereof. The respective lines then merge into a common line. The multiple stage pump prevents pressure variations. The multiple stage pump includes a first pump in a first stage and a second pump in a second stage. At least one valve is upstream from one of the first pump and the second pump in at least one of the first stage and the second stage. A common branch line connects the first stage and the second stage to a common hydraulic system.

1 Claim, 5 Drawing Sheets

METHOD OF REDUCING PRESSURE PEAKS IN A FUEL INJECTOR

CROSS REFERENCE TO RELATED APPLCIATIONS

This application is a divisional application of and claims priority to copending U.S. application Ser. No. 10/079,489 filed Feb. 22, 2002, which incorporated herein in its entirety.

The present application claims priority to U.S. provisional application Ser. No. 60/283,629, filed on Apr. 16, 2001, the entire disclosure which is incorporated herein by reference.

BACKGROUND OF THE INVENTION

1. Field of the Invention

The present invention generally relates to a multiple stage pump and, more particularly, to a variable displacement multiple stage pump for a hydraulic system.

2. Background Description

Hydraulic pumps are widely used in a vast array of automotive and heavy machinery applications. These applications may include, for example, drive vehicles, powerful hydraulic cylinders and injection systems. In current systems, pump displacement of the hydraulic pump is not adjusted to the needed amount of energy for a desired application. That is, the pump displacement is kept constant. This is mainly due to cost constraints associated with manufacturing and designing variable pump displacement systems. Thus, variable pump systems are not currently or widely used in the automotive industry due to these cost constraints.

However, it is known that fuel economy and other efficiencies can be realized by using variable pump systems. In known variable pump systems, as shown in FIG. 1, on/off switching valves 10 (e.g., 3 way/3 position valve) are located in a common rail line 12 for all of the pumps 14. The on/off switching valve 10, shown in an exploded view of FIG. 1*a,* uses two pumps to provide three different volumes; namely, (i) a small pump $V_1$ for a small flow, (ii) a large pump $V_2$ for a larger flow and (iii) both pumps together $V_1$ and $V_2$ to have a maximum flow. Thus three different volumes are generated when $V_1<V_2$ (e.g., 5 l/m, 10 l/m and 15 l/m). This arrangement, though, creates pressure peaks in the rail line 12 as well as in the pump 14, itself. Also, by using the on/off switching valves 10 in the common rail line 12, both sides (pump and rail sides) will have difficulty with the pressure peaks. That is, the 3 way/3 position valve is a "digital" volume shift which has very little influence to reduce peek pressures during switching. Thus, the pump side must handle the additional load and will have a problem with the resultant durability. Also, with these systems, on the rail side, the pressure peaks change the rail dynamic which, in turn, causes injection variations. The additional volume peak must be handled by the rail pressure regulator valve.

The present invention is directed to overcoming one or more of these problems.

SUMMARY OF THE INVENTION

An object of the present invention is to provide an adjustable or variable pump system which increases fuel efficiency.

Another object of the present invention is to provide a valve system to govern the two or more stages of a two stage pump system.

A still further object of the present invention is to eliminate or reduce pressure peaks throughout the stages of the multiple stage pump.

Another object of the present invention is to reduce or eliminate injection variation in a fuel injector.

A still further object of the present invention is to provide a two stage pump system which provides a constant pressure throughout the system.

Also another object of the present invention is to provide both the rail and the pump sites of a multistage pump with a smooth pressure profile during the transient phase from stage to stage and during different volumes.

A further object of the present invention is to provide a more stable rail volume drop in a two stage pump system.

In a first aspect of the invention, a multiple stage pump includes a first and second stage pump and at least one valve upstream from the first pump and the second pump in the first stage and the second stage. A common branch line connects the first stage and the second stage to a common hydraulic system, and a valve system is associated with the common branch line upstream from the connection of the first stage and the second stage. In embodiments of the first aspect of the present invention, the valves include a first valve upstream of the first pump in the first stage and a second valve upstream of the second pump in the second stage. Additional valves may also be including in each of the stages or, optionally, in the common branch line.

In a second aspect of the present invention, the multiple stage pump includes at least two pumps and at least two valve means for regulating fluid from the at least two pumps. The at least two valve means are upstream from the at least two pumps in a respectively same line as the at least two pumps. In embodiments, a merged line is upstream from the at least two valve means which may be, for example, control valves, flow valves, on/off valves, pressure regulated valves, pressure relief valves and the like.

In a third aspect of the present invention, a pumping system adapted for supplying fluid to an injector or other application (e.g., variable valve suspension system, etc.) includes a multiple stage pumping system having a multitude of pump stages for supplying the fluid to the injector. A flow control system provides a linear flow control throughout the multitude of pump stages while preventing pressure peaks. For each pump stage, a pressure control valve regulates the on/off function of a multitude of volumes to supply the each pump stage with the fluid.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to a multiple stage pump for hydraulic systems, and more particularly a rail and pump system adapted for providing working fluid to hydraulically controlled fuel injectors. The multiple stage pump of the present invention provides an adjustable system which increases fuel efficiency and reduces or eliminates pressure peaks throughout the stages of the multiple stage pump. The multiple stage pump of the present invention is also capable of reducing or eliminating injection variations in a fuel injector.

Figure 1:
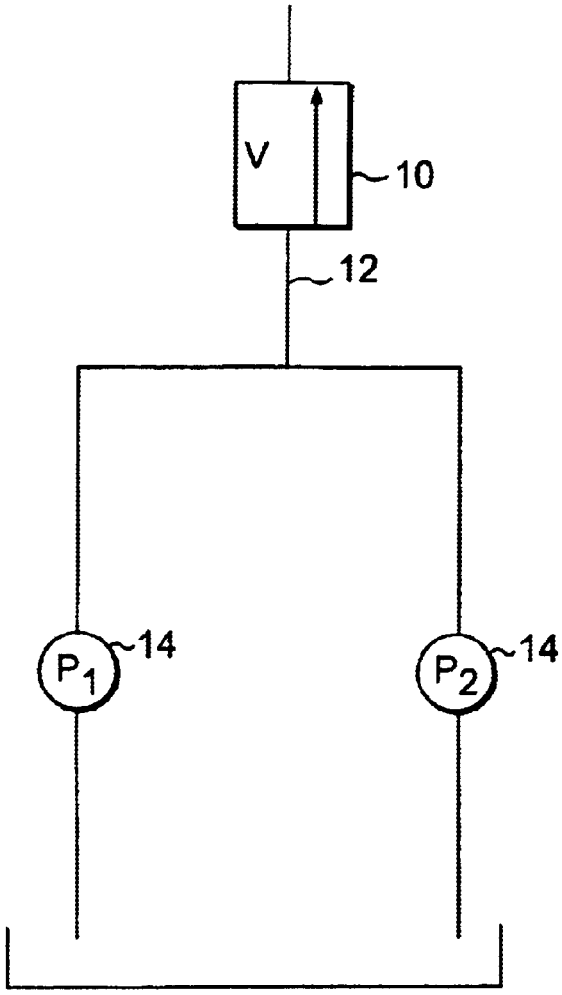
FIG. 1 PRIOR ART
FIG. 1 shows a conventional multistage pump with a control valve on a common rail.
Figure 1A:
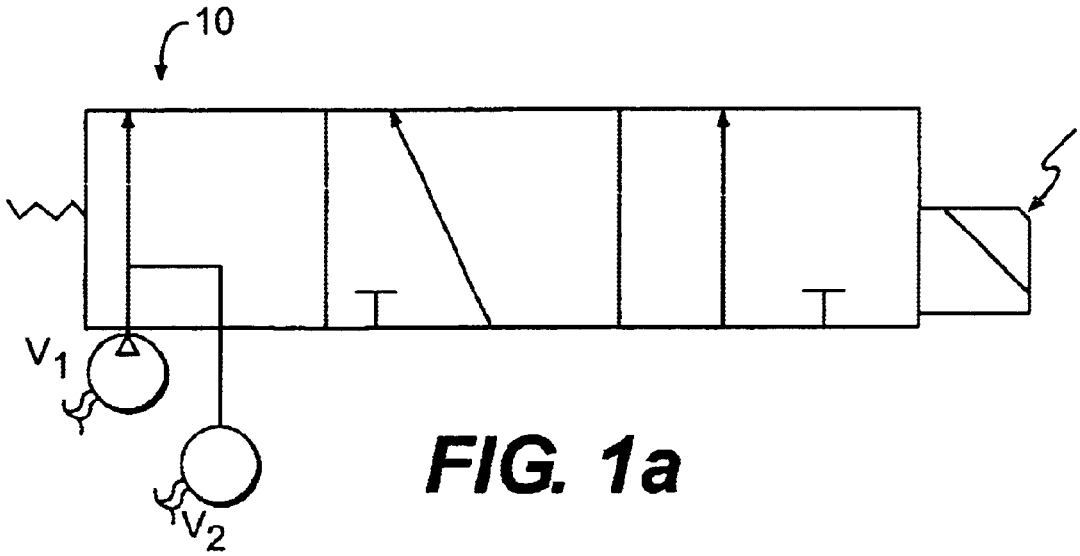
FIG. 1*a* shows an exploded view of a 3 way/3 position valve used with the system of FIG. 1.
Figure 2:
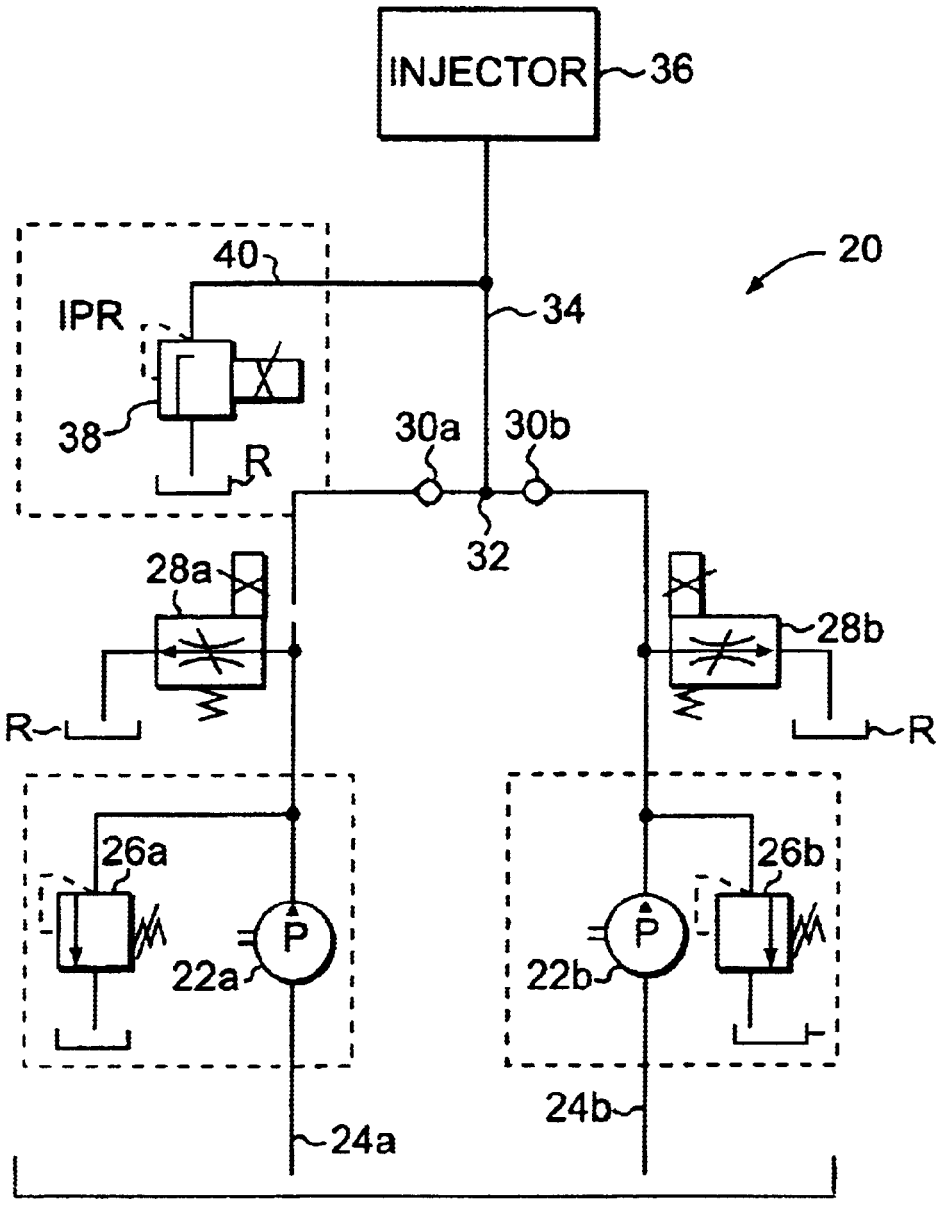
FIG. 2 shows a first embodiment of the multiple stage pump of the present invention utilizing a pressure valve.

Referring now to FIG. 2, a first embodiment of the multiple stage pump is provided. In this embodiment, the multiple stage pump is generally depicted as reference numeral 20 and includes pumps 22*a* and 22*b* located on respective branches 24*a* and 24*b* of the multiple stage pump system 20 of the present invention. The pumps 22*a,* 22*b* are preferably arranged in parallel, and may be associated with respective valve and reservoir systems 26*a,* 26*b*. In embodiments, the valve and reservoir systems 26*a,* 26*b* may include a single reservoir or, alternatively, may be eliminated without unduly affecting the control of the present invention. Pressure control valves 28*a,* 28*b* (with respective reservoirs "R" or, in embodiments, the same reservoir) are positioned upstream of the respective pumps 22*a,* 22*b,* associated with each respective branch 24*a,* 24*b* of the multiple stage pump system 20. The pressure control valves, in alternative embodiments, may be substituted with flow valves, on/off valves, or other pressure or relief control valves or a combination thereof. It should be noted that the control valves do not appear to be as sensitive to cold start behavior as the on/off valves.

Still referring to FIG. 2, check valves 30*a* and 30*b* are located upstream of the control valves 22*a,* 22*b* on each respective branch 24*a,* 24*b*. A node 32, positioned between the respective check valves 30*a,* 32*b,* merges the branches 24*a,* 24*b* into a single or common branch rail line 34. The common branch line 34 preferably provides working fluid to a fuel injector. A valve (pressure control valve) 38 with reservoir "R" may optionally be provided on a line 40, branching from the common branch rail line 34. The valve and reservoir system may be a rail pressure regulator valve such as an Injection Pressure Regulator (IPR). The arrangement of FIG. 2 reduces or eliminates pressure peaks throughout the multiple stage pump 20, and further reduces or eliminates injector to injector variation caused by the system.

Figure 3:
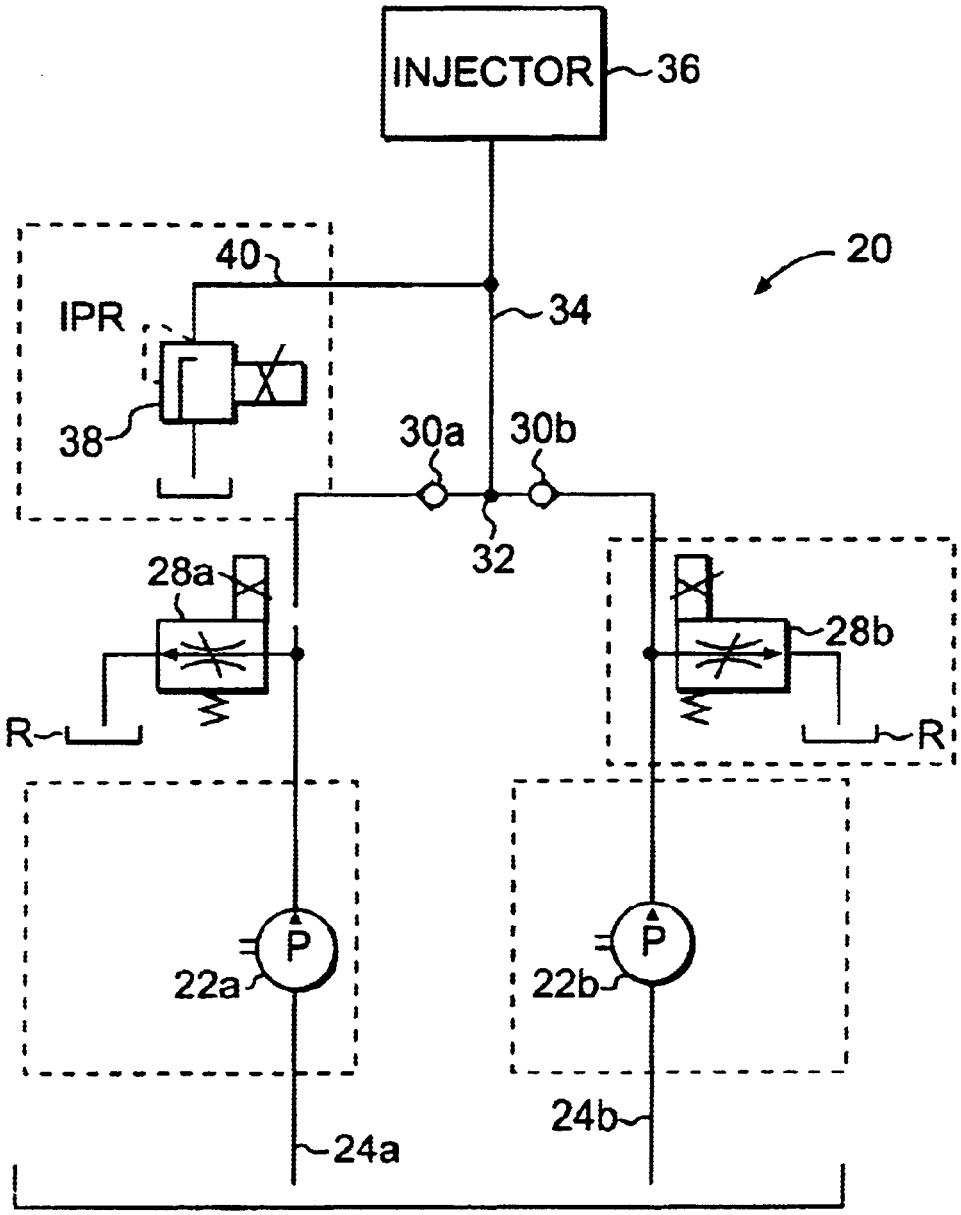
FIG. 3 shows another embodiment of the multiple stage pump of the present invention utilizing a flow valve.

FIG. 3 shows an alternative embodiment to FIG. 2. In FIG. 3, the valves 26*a,* 26*b* are removed from the multiple stage pump system 20. (However, the system of FIG. 3 can also be operated with pressure control valves.) Also, the flow control valve 28*b* may also be optional; that is, the flow control valve 28*b* may be removed from the system. It is noted that flow control valve 28*a* may be removed from the system, instead of flow control valve 28*b*. When optionally removing one of the flow control valves 28*a* or 28*b,* the system of the present invention can still adequately regulate the pressure of the working fluid. This can be performed using the control valve that is in direct communication (on the same branch line) with the pump in combination with the pressure control valve 38.

Still referring to FIG. 3, it should further be recognized by those of ordinary skill in the art that the pressure control valve 38 may be optional if the pressure regulation is not stable enough. That is, basically, the system of FIG. 3 may work equally well without pressure control valve 38. Also, the system of FIG. 3 may be used without peak pressure valves due to the fact that the pressure control valves 28*a,* 28*b* regulate the transient phase without hydraulic waves and pressure peaks.

Figure 4:
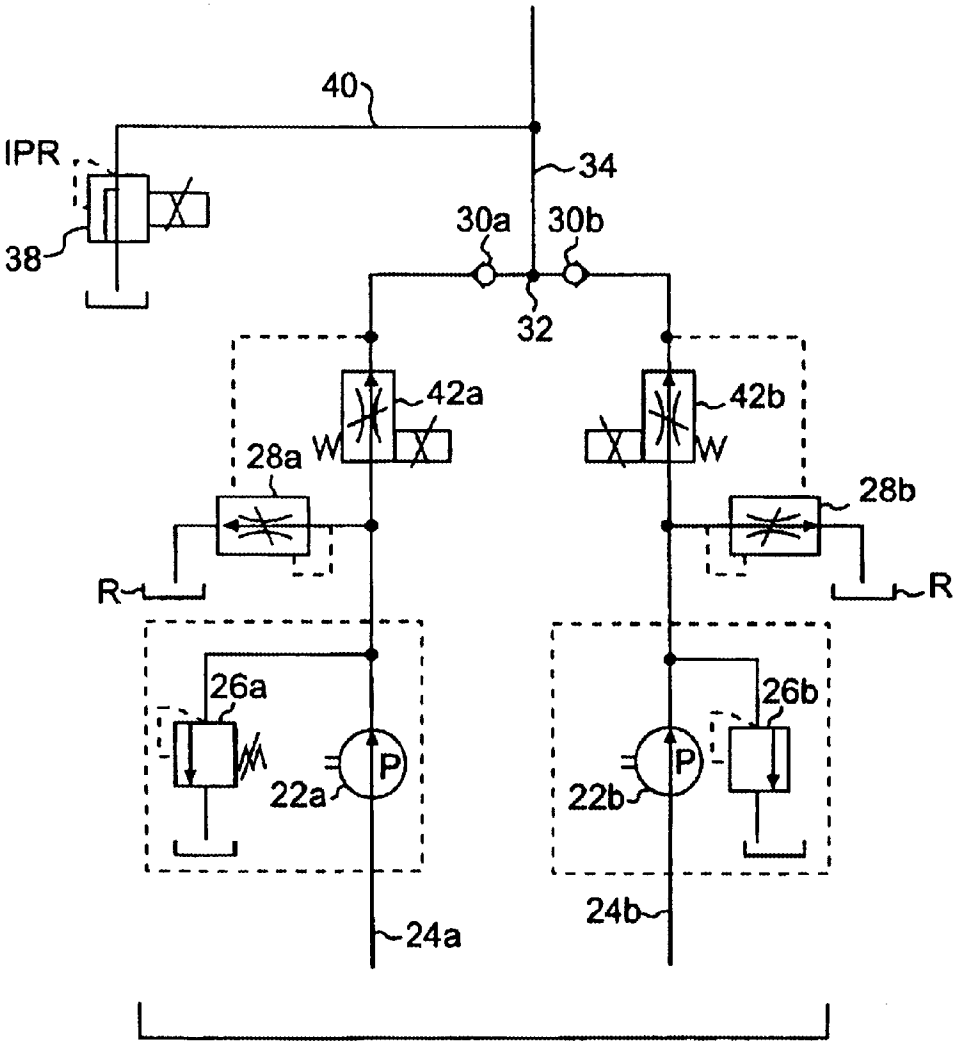
FIG. 4 shows another embodiment of the multiple stage pump of the present invention utilizing a flow valve with a flow closed loop control.

FIG. 4 shows still another alternative embodiment of the present invention. In this embodiment, additional valves 42*a,* 42*b* may be positioned in line with the respective pumps 22*a,* 22*b* on branch lines 24*a,* 24*b,* respectively. Valves 42*a* and 42*b* are governing throttle valves which may control the flow control valves 28*a* and 28*b*, respectively. Said otherwise, the pressure delta (Δ) in valves 42*a* and 42*b* may control the flow through the pressure control valves 28*a* and 28*b,* respectively. Like FIG. 3, the valve 38 is optional. The solution of FIG. 4 will keep the system pressure constant by changing the volume in line 34. This is the best way to keep the pressure for the injectors constant. It is important to reduce the system variability in order to obtain a constant injector quantity especially for pilot quantities (1–2 $mm^3$).

Figure 5:
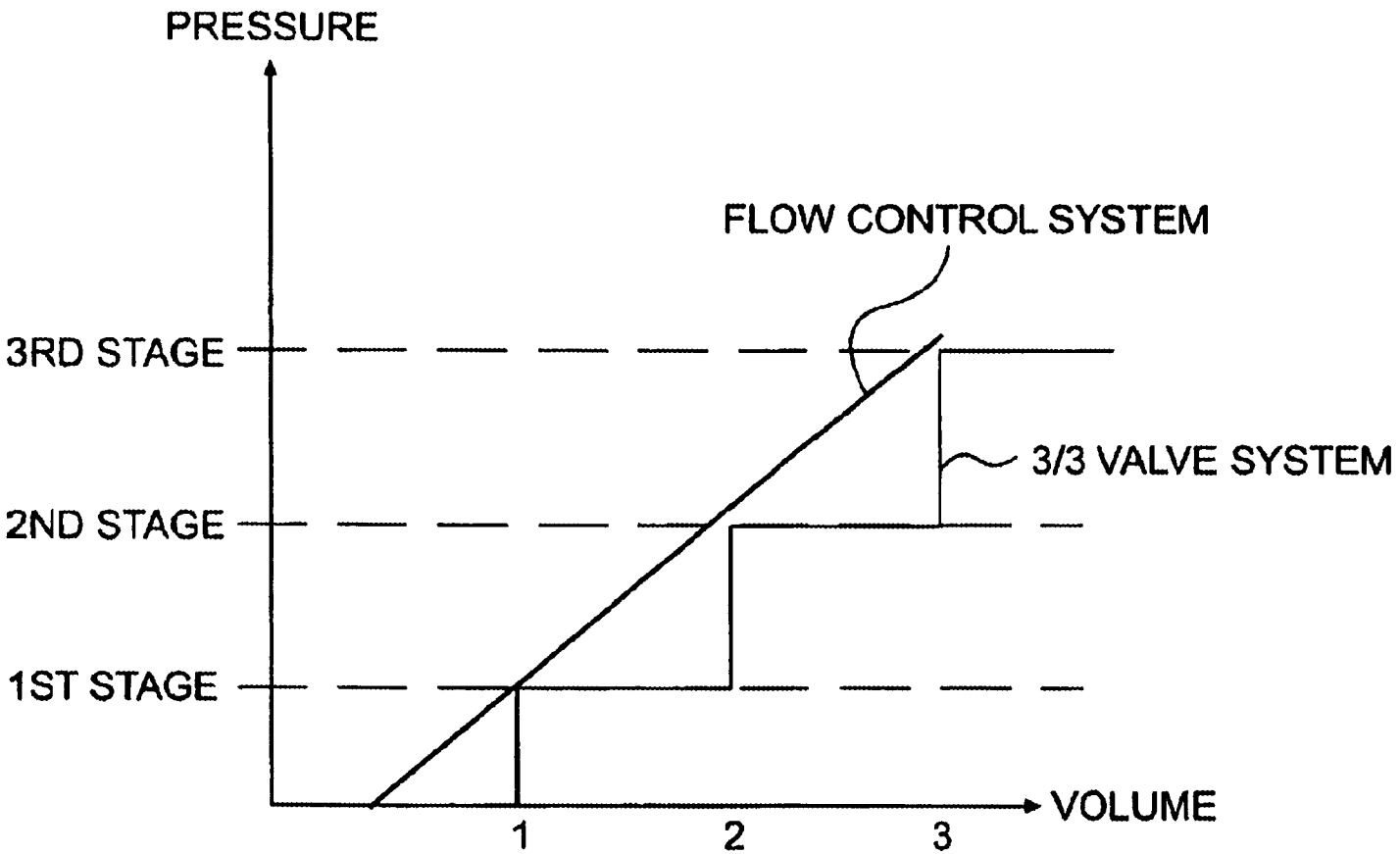
FIG. 5 shows a performance graph using the multiple stage pump of the present invention.

FIG. 5 shows a performance graph associated with the present invention. This graph compares the 3 way/3 position valve system to the flow control valve system of the present invention. This graph is shown in three stages. As seen, the flow valve control system of the present invention provides a linear flow control (without any pressure peaks) throughout the three stages thus providing advantages over the stepped flow of the 3 way/3 position valve system (when $V_1 \leqq V_2$).

As thus described above, the underlying concept of the present invention is to control the hydraulic pressure with valves such as, for example, control valves or other pressure regulation valves. For each pump stage, a pressure control valve is positioned to regulate the on/off function of three possible volumes to supply the system with working fluid. By way of example, on the way to the common branch rail, the fluid flow passes a check valve, preferably after each pump stage, before the flow is combined in the one common branch line. The check valves ensure that the opposite side pump is not running against a low pressure of a valve which is in the "off" position. Also, the control valves smoothly regulate the switching without pressure peaks throughout the system (including the pumps).

It should be understood by those of ordinary skill in the art that the control valves may be positioned in parallel and in line to the respective reservoirs. This arrangement results in the elimination of pressure drops (from the valves) in the common branch line. Also, a fail safe position can be designed in a way that in a case of a valve failure the closed position (high-pressure position) is the start position for the control valve. The control valves of the present invention are driven by solenoids (electric); however, in case of power failure, the system is still capable of producing pressure (not controlled) in order to run the engine within a small range. In this manner, the design of the control valves can now be designed to have the most optimum pressure drop at room temperature or higher. This translates into a smaller valve cross sections.

Also, by using the system of the present invention both the rail and the pump sites will not have any pressure peaks during the transient phase from stage to stage and different volumes. The flow and pressure regulation of the working fluid can thus occur very smoothly. The advantage to the smooth regulation thereof is that in addition to the pressure control valve, the volume of the working fluid can be increased to the actual need in the system. This increased volume can, in turn, assist the acceleration strategy for the engine (i.e., more torque and rpm of the engine requires more fluid delivery). The volume can also be adjusted and controlled to the current use utilizing the system of the present invention. The control valve system of the present invention, unlike other systems, provides a proportional continuous change of the fluid flow with the "proportional flow valve". The change from the $V_1$ to $V_2$ is a steady stage change of the bypass (valves 28*a* and 28*b*) and reduction of the flow will increase the flow to the rail without having a "digital" change as seen in FIG. 5. Now, each different volume can be achieved by adjusting the volume and oil flow to the bypass. The pressure valve 38 may still maintain the pressure constant during the transient phase of the volumes.

Further, the rail volume drop during an injection cycle can be much more stable based on the fact that the used fluid volume will be delivered from the flow control valve, as well. Note also that with pressure control valves arranged in the manner described above, the pressure drop will be adjusted if the response time is given from the closed loop. Thus, the control strategy can be adjusted to the known cycle of the system.

While the invention has been described in terms of preferred embodiments, those skilled in the art will recognize that the invention can be practiced with modification within the spirit and scope of the appended claims.

I claim:

1. A method of reducing or eliminating pressure peaks in a fuel injector, comprising the steps of:

pressurizing a first fluid flow in a first pumping stage;

pressurizing a second fluid flow in a second pumping stage;

controlling a flow of fluid through a valve system of the first and second pumping stage to prevent pressure peaks throughout the first and second pumping stage; and merging the first and second fluid flow from the first pumping stage and the second pumping stage into a common branch line, wherein the controlling step prevents pressure peaks in the common branch line, and the fluid flow passes a check valve in the first and second pumping stage before merging in the common branch line such that a pump in one of the first and second pumping stage is not running against a low pressure of another pump in another of the one of the first and second pumping stage.

* * * * *

UNITED STATES PATENT AND TRADEMARK OFFICE

CERTIFICATE OF CORRECTION

PATENT NO. : 6,869,274 B2
DATED : March 22, 2005
INVENTOR(S) : Bernd Niethammer

It is certified that error appears in the above-identified patent and that said Letters Patent is hereby corrected as shown below:

Column 2,
Lines 14, 18, 21, 22, 28 and 30, please delete “upstream”, and insert -- downstream --.

Column 3,
Lines 22 and 31, please delete “upstream”, and insert -- downstream --.

Signed and Sealed this

Fourth Day of October, 2005

JON W. DUDAS
*Director of the United States Patent and Trademark Office*